US009696665B2

(12) United States Patent
Inada

(10) Patent No.: US 9,696,665 B2
(45) Date of Patent: Jul. 4, 2017

(54) IMAGE FORMING APPARATUS INCLUDING WASTE TONER CONTAINER

(71) Applicant: KYOCERA Document Solutions Inc., Osaka-shi, Osaka (JP)

(72) Inventor: Teruhiko Inada, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/197,530

(22) Filed: Jun. 29, 2016

(65) Prior Publication Data

US 2017/0003627 A1 Jan. 5, 2017

(30) Foreign Application Priority Data

Jun. 30, 2015 (JP) ..... 2015-131858

(51) Int. Cl.
*G03G 15/16* (2006.01)
*G03G 21/10* (2006.01)

(52) U.S. Cl.
CPC ..... *G03G 15/161* (2013.01); *G03G 21/105* (2013.01)

(58) Field of Classification Search
CPC ..... G03G 15/161; G03G 21/105
USPC ..... 399/358, 101
See application file for complete search history.

(56) References Cited

U.S. PATENT DOCUMENTS 8,983,357 B2 * 3/2015 Sakashita ..... G03G 15/0189 399/358
2008/0089727 A1 * 4/2008 Shimizu ..... G03G 21/105 399/360
2008/0095559 A1 4/2008 Shimizu et al.
2012/0213568 A1 * 8/2012 Yamamoto ..... G03G 21/12 399/358
2014/0044465 A1 * 2/2014 Mekada ..... G03G 21/12 399/358
2014/0270841 A1 * 9/2014 Sato ..... G03G 15/6558 399/101
2014/0294475 A1 * 10/2014 Nishikawa ..... G03G 21/105 399/358
2015/0268585 A1 * 9/2015 Kadowaki ..... G03G 21/105 399/358

(Continued)

FOREIGN PATENT DOCUMENTS

JP 2008122925 A 5/2008

*Primary Examiner* — Susan Lee
(74) *Attorney, Agent, or Firm* — Alleman Hall Creasman & Tuttle LLP

(57) ABSTRACT

An image forming apparatus includes an apparatus main body, a drum unit, an intermediate transfer unit, a waste toner container, and a first guide portion. The drum unit includes a photoconductor drum. The intermediate transfer unit includes a transfer belt and a belt cleaning portion. The belt cleaning portion removes waste toner remaining on the transfer belt and conveys the waste toner toward one side in a width direction of the transfer belt. The waste toner container is provided below an end of the drum unit on the one side and includes an introduction port that introduces waste toner to an inside of the waste toner container. The first guide portion guides the waste toner conveyed by the belt cleaning portion to the one side, from the introduction port to the inside of the waste toner container.

7 Claims, 19 Drawing Sheets

(56) References Cited

U.S. PATENT DOCUMENTS

2016/0132017 A1* 5/2016 Sato ..... G03G 21/169
399/120

* cited by examiner

IMAGE FORMING APPARATUS INCLUDING WASTE TONER CONTAINER

INCORPORATION BY REFERENCE

This application is based upon and claims the benefit of priority from the corresponding Japanese Patent Application No. 2015-131858 filed on Jun. 30, 2015, the entire contents of which are incorporated herein by reference.

BACKGROUND

The present disclosure relates to an image forming apparatus in which waste toner removed from an intermediate transfer belt is guided to a waste toner container.

A color image forming apparatus includes a plurality of photoconductor drums, and a plurality of cleaning devices respectively provided for the photoconductor drums. In addition, the color image forming apparatus includes an intermediate transfer belt for carrying toner images of a plurality of colors transferred from the photoconductor drums. The toner images on the intermediate transfer belt are transferred to a sheet member by a transfer device. During this process, toner that has not been transferred to the sheet member may remain on the surface of the intermediate transfer belt. For this reason, the color image forming apparatus includes a cleaning device for removing the toner that has remained on the intermediate transfer belt. The color image forming apparatus includes a waste toner container for storing the waste toner discharged from the cleaning device. Conventionally, a toner conveyance path is formed in a section from the cleaning device to the waste toner container, and the waste toner removed by the cleaning device passes through the toner conveyance path and is guided to the waste toner container.

SUMMARY

An image forming apparatus according to an aspect of the present disclosure includes an apparatus main body, a drum unit, an intermediate transfer unit, a waste toner container, and a first guide portion. The drum unit is provided in the apparatus main body and includes a photoconductor drum configured to carry a toner image developed by a developing device. The intermediate transfer unit is provided above the drum unit in the apparatus main body and includes a transfer belt and a belt cleaning portion. The transfer belt is configured to carry a toner image primarily transferred from the photoconductor drum, to a position at which a secondary transfer is performed to a sheet member. The belt cleaning portion is configured to remove waste toner remaining on the transfer belt and convey the waste toner toward one side in a width direction of the transfer belt. The waste toner container is provided below an end of the drum unit on the one side and includes an introduction port configured to introduce waste toner to an inside of the waste toner container. The first guide portion is configured to guide the waste toner that has been conveyed by the belt cleaning portion to the one side, from the introduction port to the inside of the waste toner container.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
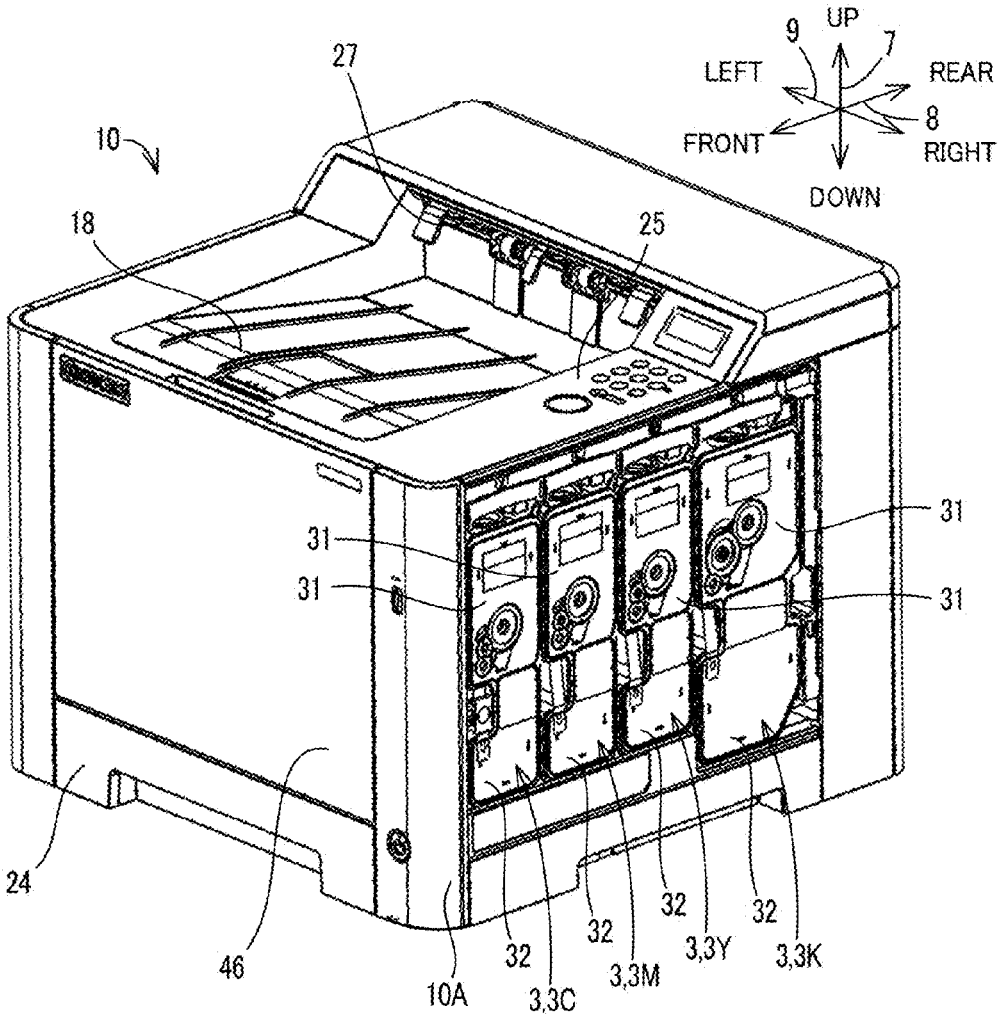
FIG. 1 is a right perspective view of an image forming apparatus according to an embodiment of the present disclosure.

The following describes an embodiment of the present disclosure with reference to the drawings. It should be noted that the following embodiment is an example of a specific embodiment of the present disclosure and should not limit the technical scope of the present disclosure. For the sake of explanation, an up-down direction 7 is defined as the vertical direction in an installment state where the image forming apparatus 10 is installed usable (the state shown in FIG. 1). In addition, a front-rear direction 8 is defined such that a side at which insertion/removal of a sheet feed cassette 24 shown in FIG. 1 is performed in the installment state is the front side. Furthermore, a left-right direction 9 is defined based on the front side of the image forming apparatus 10 in the installment state.

The image forming apparatus 10 according to an embodiment of the present disclosure is a tandem color printer that has at least a print function.

Figure 2:
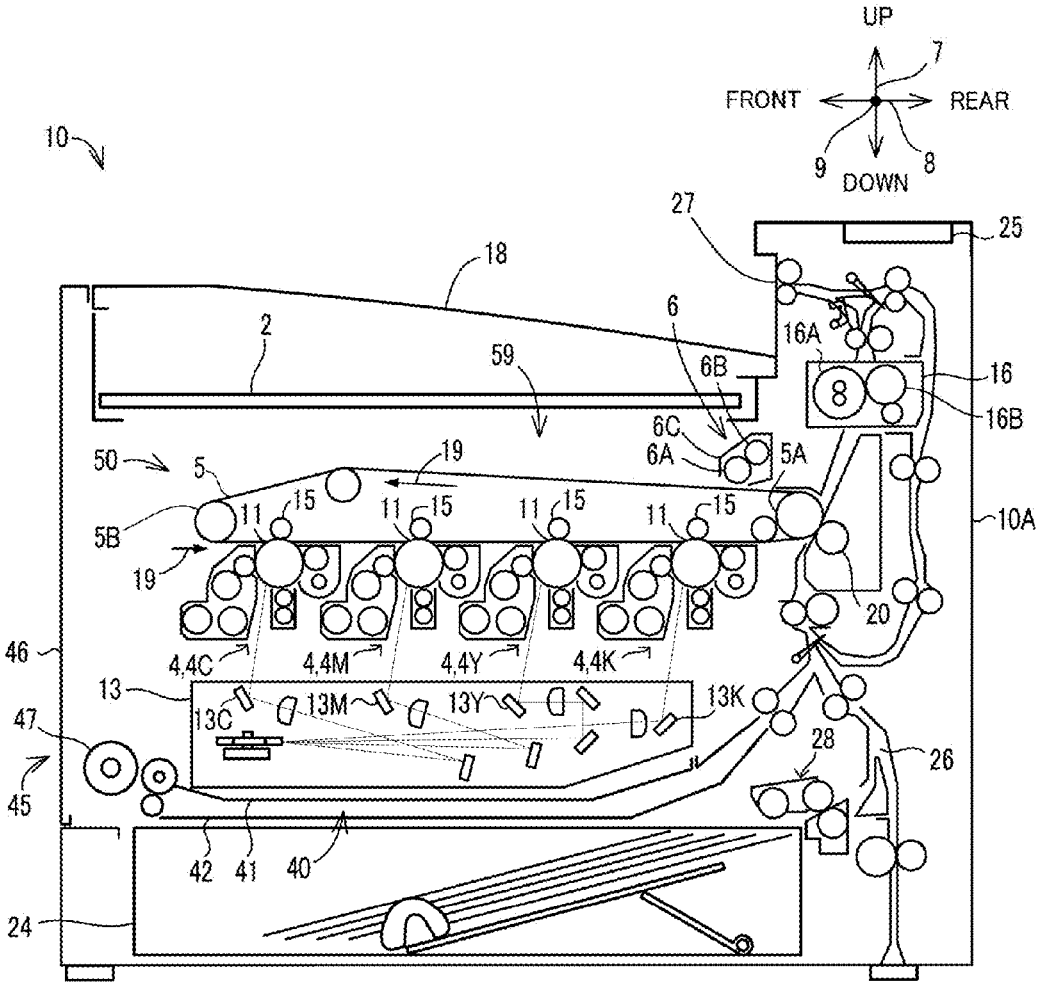
FIG. 2 is a cross-sectional view showing a configuration of the image forming apparatus.
Figure 3:
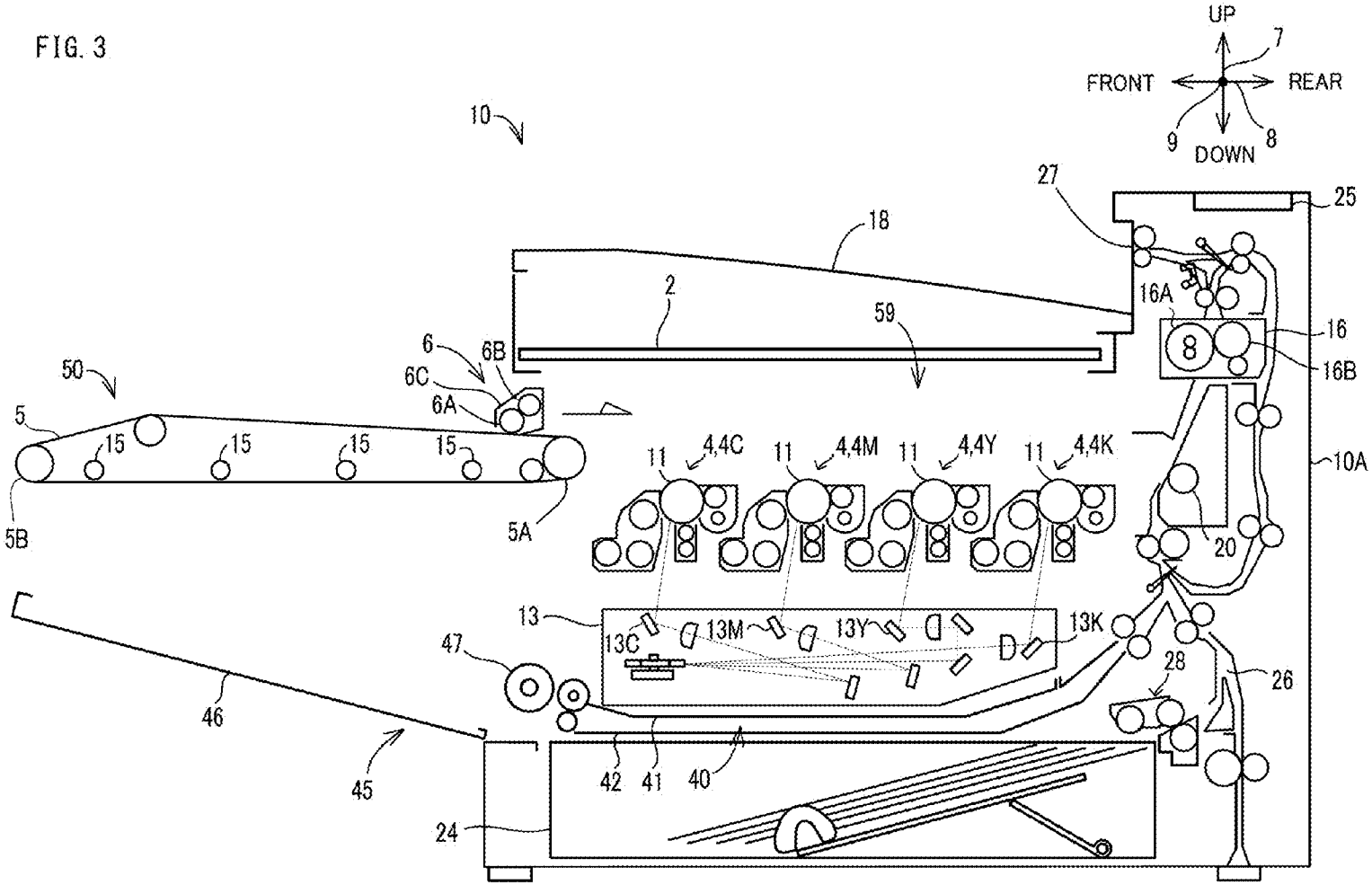
FIG. 3 is a cross-sectional view showing the configuration of the image forming apparatus.

As shown in FIG. 1 to FIG. 3, the image forming apparatus 10 includes a housing 10A (an example of the apparatus main body of the present disclosure). The housing 10A has an approximately parallelepiped shape as a whole. Some of the components constituting the image forming apparatus 10 are stored in the housing 10A. It is noted that FIG. 1 shows a state where a right side cover of the housing 10A has been removed.

As shown in FIG. 2, the image forming apparatus 10 includes a plurality of image forming units 4, an intermediate transfer unit 50, a laser scanning device 13, a secondary transfer roller 20, a fixing device 16, a sheet tray 18, a sheet feed cassette 24, a sheet feed unit 28, an operation/display portion 25, a vertical conveyance path 26, and a control board 2.

Figure 4:
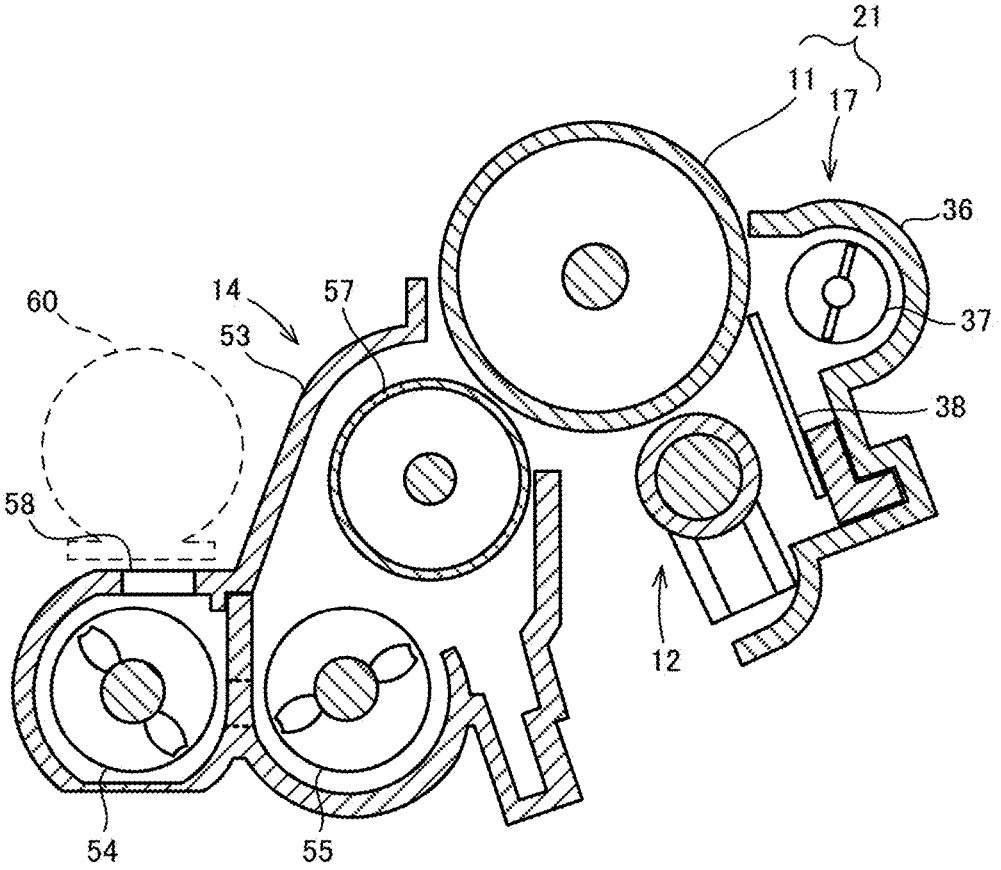
FIG. 4 is a cross-sectional view of a central portion of an image forming unit included in the image forming apparatus.

FIG. 4 is a cross-sectional view of a central portion of the image forming units 4 in the left-right direction 9. As shown in FIG. 4, each of the image forming units 4 (4C, 4M, 4Y and 4K) includes a drum unit 21, a charging device 12, and a developing device 14. The image forming units 4 are arranged in alignment along the front-rear direction 8 in the housing 10A, and form a color image based on the so-called tandem system. Specifically, the image forming units 4C, 4M, 4Y and 4K are configured to form toner images of cyan, magenta, yellow and black, respectively. The image forming units 4C for cyan, 4M for magenta, 4Y for yellow and 4K for black are arranged in alignment in the stated order from the upstream side in the running direction (the direction indicated by the arrow 19) of the intermediate transfer unit 50.

The drum unit 21 includes a photoconductor drum 11, a drum cleaning device 17 (an example of the drum cleaning portion of the present disclosure), a toner guide portion 85 (see FIG. 10), and a housing 36 that supports these components. The toner guide portion 85 is an example of the second guide portion of the present disclosure. The first guide portion of the present disclosure is composed of the toner guide portion 85 and a relay guide portion 100. The photoconductor drum 11 has a cylindrical shape and carries a toner image developed by the developing device 14. The photoconductor drum 11 is rotatably supported by the housing 36.

In each of the image forming units 4, the charging device 12 uniformly charges the photoconductor drum 11 to a certain potential. Subsequently, the laser scanning device 13 irradiates a laser beam on the surface of the photoconductor drum 11 based on the image data, thereby forming electrostatic latent images on the surfaces of the respective photoconductor drums 11. The electrostatic latent images are developed (visualized) as toner images by the developing device 14, respectively. The toner images of respective colors formed on the surfaces of the photoconductor drums 11 are primarily transferred to a transfer belt 5 by primary transfer rollers 15 such that the toner images are overlaid with each other in sequence, wherein the primary transfer rollers 15 are described below. Next, the color image on the intermediate transfer belt 5 is secondarily transferred by the secondary transfer roller 20 to a print sheet that is conveyed from the sheet feed cassette 24 via the vertical conveyance path 26.

The drum cleaning device 17 is configured to remove toner that has remained on the photoconductor drum 11 after the primary transfer. The drum cleaning device 17 is disposed on the rear side of the photoconductor drum 11. A drum cleaning device 17 is provided for each photoconductor drum 11. The drum cleaning device 17 includes a cleaning blade 38 that is a cleaning member, and a spiral member 37. The cleaning blade 38 and the spiral member 37 are supported by the housing 36. The cleaning blade 38 has approximately the same length as the photoconductor drum 11. The tip of the cleaning blade 38 is disposed so as to be in contact with or close to the surface of the photoconductor drum 11. The spiral member 37 is a conveyance member having a spiral blade around a shaft. The spiral member 37 is rotatably supported in the housing 36.

The spiral member 37 is rotated when a rotational driving force is input to its shaft. While the photoconductor drum 11 is rotated, the cleaning blade 38 removes toner that has remained on the surface of the photoconductor drum 11 after the primary transfer by the primary transfer roller 15. The removed toner (waste toner) is conveyed toward a certain direction by the spiral member 37 as it rotates. Specifically, the waste toner is conveyed toward one side (in the present embodiment, the right side) in the axis direction (longitudinal direction) of the photoconductor drum 11. The toner guide portion 85 is provided at the right end of the housing 36. The waste toner is guided downward by the toner guide portion 85, passes through a discharge port 92 (see FIG. 11) that is described below, and is discharged to a lower storage portion 32 of a toner container 3.

As shown in FIG. 4, the developing device 14 includes a housing 53, a first stirring member 54, a second stirring member 55, and a developing roller 57. Toner (developer) is stored in a bottom portion of the housing 53 and the toner is conveyed while being stirred by the first stirring member 54 and the second stirring member 55. A supply port 58 is formed in a wall of the housing 53 that is located above the first stirring member 54. Toner is supplied from the supply port 58 into the housing 53. The developing roller 57 draws up toner from the second stirring member 55 by the magnetic pole embedded therein, and carries the toner on its circumferential surface. The toner held by the developing roller 57 is caused to adhere to the electrostatic latent image on the photoconductor drum 11 by the potential difference applied to between the developing roller 57 and the photoconductor drum 11.

As shown in FIG. 1, toner containers 3 of respective colors (3C, 3M, 3Y and 3K) are attached, in a detachable manner, to the developing devices 14, respectively. Each of the toner containers 3 includes an upper storage portion 31 and a lower storage portion 32, wherein toner for supply is stored in the upper storage portion 31 and discharged waste toner is stored in the lower storage portion 32. Toner is supplied to the inside of the developing device 14 from the upper storage portion 31 of each toner container 3. In addition, waste toner discharged from the drum cleaning devices 17 passes through the toner guide portions 85, and is stored in the lower storage portions 32 of the toner containers 3. In the present embodiment, as shown in FIG. 1, four toner containers 3 are respectively attached to the right sides of the image forming units 4 in the housing 10A on the right side. The toner containers 3 are arranged on the right side of the housing 10A in alignment along the front-rear direction 8. The toner containers 3 are described in detail below.

As shown in FIG. 2, the intermediate transfer unit 50 is provided above the four image forming units 4 in the housing 10A. More specifically, the intermediate transfer unit 50 is provided above the photoconductor drums 11. Specifically, the intermediate transfer unit 50 is disposed in a space 59 that is surrounded by the image forming units 4 and the control board 2. The intermediate transfer unit 50 includes a transfer belt 5, a driving roller 5A, a driven roller 5B, the primary transfer rollers 15, a belt cleaning device 6 (an example of the belt cleaning portion of the present disclosure), the relay guide portion 100 (see FIG. 13), and a unit frame 51 (see FIG. 5) that supports these components. It is noted that the relay guide portion 100 constitutes a part of the first guide portion of the present disclosure.

The transfer belt 5 is suspended between the driving roller 5A and the driven roller 5B so as to extend in the front-rear direction 8. A plurality of drum units 21 are arranged in alignment in the front-rear direction 8 along the transfer belt 5. The transfer belt 5 carries a toner image that is formed from toner images of a plurality of (in the present embodiment, four) colors. The transfer belt 5 is an annular belt member onto which toner images of respective colors formed on the photoconductor drums 11 are primarily transferred. The transfer belt 5 carries a color toner image formed from the toner images primarily transferred from the photoconductor drums 11. The transfer belt 5 is supported by the driving roller 5A and the driven roller 5B that are supported by the unit frame 51 so as to be rotationally driven (see FIG. 5). Upon being rotationally driven by the driving roller 5A and the driven roller 5B, the transfer belt 5 moves (runs) while its surface is in contact with the surfaces of the photoconductor drums 11. When the transfer belt 5 is rotationally driven, its surface passes between the photoconductor drums 11 and the primary transfer roller 15. During that movement, the toner images of the different colors carried on the photoconductor drum 11 are secondarily transferred in sequence to the transfer belt 5 in such a way as to be overlaid with each other.

The belt cleaning device 6 is disposed in the vicinity of the fixing device 16. Specifically, the belt cleaning device 6 is provided above the transfer belt 5 on the rear side of the housing 10A. Below the belt cleaning device 6, the image forming unit 4K, which is an image forming unit 4 for black, is disposed. That is, the belt cleaning device 6 is located closest to the image forming unit 4K among the plurality of image forming units 4.

The belt cleaning device 6 is configured to remove the waste toner that has remained on the surface of the transfer belt 5, and convey the removed waste toner toward the lower storage portion 32 of the toner container 3K. The belt cleaning device 6 includes a cleaning roller 6A that is elongated in the left-right direction 9, a spiral member 6B as a conveyance member for conveying the waste toner, and a housing 6C for storing these components. The cleaning roller 6A is configured to remove the waste toner from the surface of the transfer belt 5 by being rotated while in contact with the surface of the transfer belt 5. The toner (waste toner) thus removed is conveyed in a certain direction by the rotating spiral member 6B. Specifically, the waste toner is conveyed toward one side in the width direction (left-right direction 9) of the transfer belt 5 (in the present embodiment, conveyed toward the right side). At the right end of the housing 6C, the relay guide portion 100 (see FIG. 13) is integrally formed with the housing 6C. The waste toner is guided downward by the relay guide portion 100, passes through the toner guide portion 85 of a drum unit 21 located at the most rear side (see FIG. 10), and is discharged to the lower storage portion 32 of the toner container 3K. It is noted that the relay guide portion 100 is described below.

The laser scanning device 13 is provided below the four image forming units 4. The laser scanning device 13 includes mirrors 13C, 13M, 13Y and 13K on which the laser beam is irradiated.

The sheet feed cassette 24 is provided in a bottom part of the housing 10A.

A conveyance path 40 is formed between the laser scanning device 13 and the sheet feed cassette 24. The conveyance path 40 is a space between an upper guide member 41 and a lower guide member 42. The conveyance path 40 is connected to the vertical conveyance path 26 in the rear side of the image forming apparatus 10.

A manual sheet feed portion 45 is provided in the front side of the image forming apparatus 10. The sheet feed portion 45 feeds a print sheet to the secondary transfer roller 20 via the conveyance path 40 and the vertical conveyance path 26 in the image forming apparatus 10. The sheet feed portion 45 includes a sheet receiving portion 46 and a feeding portion 47. The sheet receiving portion 46 serves also as a front cover of the housing 10A of the image forming apparatus 10. The sheet receiving portion 46 is configured to open and close the entrance of the conveyance path 40 at the front side of the housing 10A. FIG. 2 shows a state where the sheet receiving portion 46, namely, the front side of the housing 10A is closed. FIG. 3 shows a state where the sheet receiving portion 46, namely, the front side of the housing 10A is opened. When the sheet receiving portion 46 on the front side of the housing 10A is opened such that its inner surface faces up, a print sheet of a predetermined size can be placed on the inner surface. A print sheet placed on the sheet receiving portion 46 is fed by the feeding portion 47 to the conveyance path 40. A pair of conveyance rollers (not illustrated) are provided in the conveyance path 40, and the print sheet is conveyed by the pair of conveyance rollers toward the downstream side in the conveyance path 40.

In addition, FIG. 2 shows a state where the intermediate transfer unit 50 is installed in the space 59 of the housing 10A. The position shown in FIG. 2 is the installment position of the intermediate transfer unit 50 in the housing 10A. That is, the intermediate transfer unit 50 is supported by the housing 10A in such a way as to be inserted and removed horizontally in the front-rear direction 8 to/from the installment position in the housing 10A.

The secondary transfer roller 20 is disposed in the rear side of the housing 10A at a position facing the driving roller 5A. An image is transferred from the transfer belt 5 to a print sheet by the secondary transfer roller 20. When the intermediate transfer unit 50 is installed at the installment position, the transfer belt 5 is nipped by the driving roller 5A and the secondary transfer roller 20.

The fixing device 16 is provided above the secondary transfer roller 20. The fixing device 16 includes a heating roller 16A heated by a heating device, and a pressure roller 16B disposed to face the heating roller 16A. The fixing device 16 fixes a color image to a print sheet conveyed from the secondary transfer roller 20 to the fixing device 16.

The sheet tray 18 is provided on the upper surface of the housing 10A. The print sheet that has passed through the fixing device 16 is discharged from a sheet discharge port 27 to the sheet tray 18.

The control board 2 is disposed above the intermediate transfer unit 50. Specifically, the control board 2 is disposed between the sheet tray 18 and the intermediate transfer unit 50. The control board 2 is configured to control the components of the image forming apparatus 10.

Figure 5:
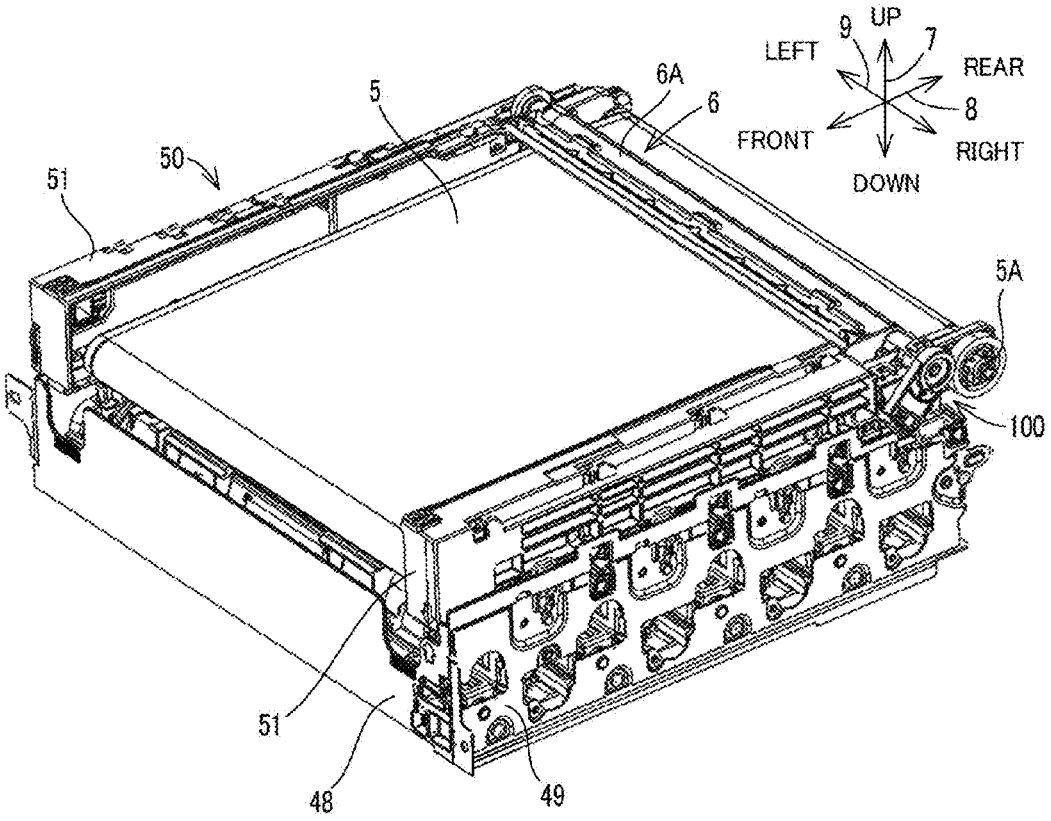
FIG. 5 is a perspective view of an intermediate transfer unit.

As shown in FIG. 5, the intermediate transfer unit 50 is provided on a storage frame 48 that stores the four image forming units 4. A container support plate 49 is supported by a right end portion of the storage frame 48. The four toner containers 3 are attached to the container support plate 49 in a detachable manner. That is, the toner containers 3 are provided more on the right side than the drum units 21 included in the image forming units 4. In the present embodiment, the four toner containers 3 are provided in correspondence with the four drum units 21.

Meanwhile, in the conventional image forming apparatuses, if the miniaturization or space saving is given a priority, the toner conveyance path from the belt cleaning device 6 of the transfer belt 5 to the conventional-type waste toner container would have a complicated configuration. In that case, waste toner would not be conveyed smoothly, and would be accumulated and adhered to the toner conveyance path. On the other hand, if a smooth conveyance of waste toner is given a priority and the toner conveyance path has a simple configuration, the apparatus would become large in size. With these taken into account, the image forming apparatus 10 of the present embodiment adopts a configuration where the supply toner is stored in the upper storage chamber 65 of each toner container 3 and the waste toner is stored in the lower storage chamber 66 of each toner container 3. This configuration of the present embodiment realizes the miniaturization and space saving of the apparatus while enabling the waste toner to be guided to the lower storage chamber 66 by a simple configuration without a wasteful space.

In the following, a configuration of the toner container 3K is described with reference to FIG. 6 to FIG. 8. It is noted that FIG. 6 to FIG. 8 also show a toner container 3Y that is adjacent to the toner container 3K. The toner container 3K is larger in outer shape and capacity than the toner container 3Y since the toner container 3K stores black toner that is largely used in amount, but except for this, they have approximately the same configuration. As a result, in the following description, the components of the toner container 3Y are assigned the same reference signs as those of the toner container 3K, and description thereof is omitted. It is noted that the toner containers 3C and 3M each have the same outer shape and capacity as the toner container 3Y.

Figure 6:
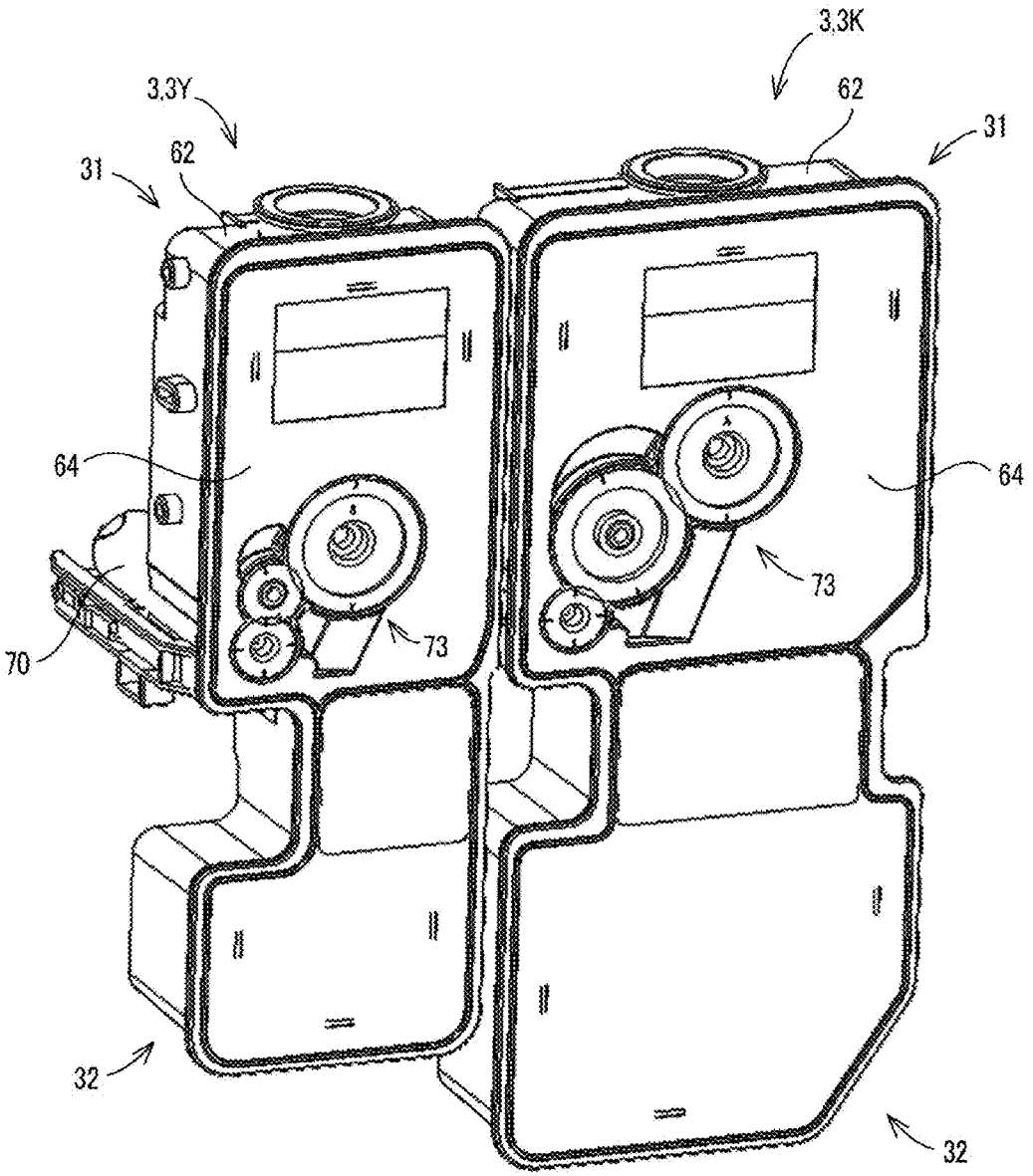
FIG. 6 is a perspective view showing outer appearances of toner containers.
Figure 7:
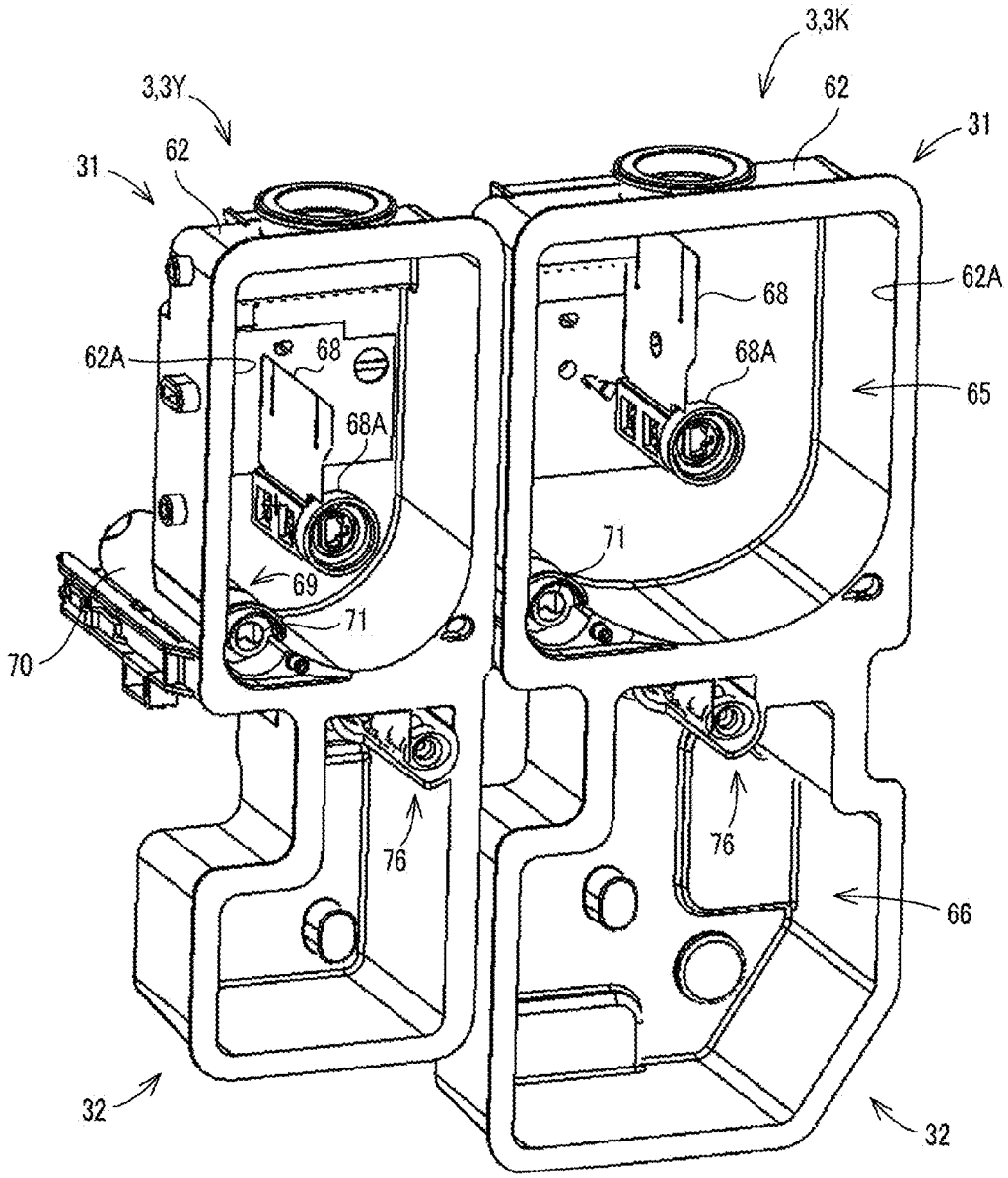
FIG. 7 is a perspective view showing internal configurations of the toner containers.

As shown in FIG. 6 and FIG. 7, the toner container 3K includes a container main body 62 and a lid 64 that covers an opening 62A of the container main body 62. The container main body 62 includes an upper storage chamber 65 formed in the upper side, and a lower storage chamber 66 formed in the lower side. The upper storage chamber 65 and the lower storage chamber 66 are separated from each other and are aligned in the up-down direction. Toner for supply is stored in the upper storage chamber 65 and waste toner is stored in the lower storage chamber 66. Closing the opening 62A of the container main body 62 by the lid 64 provides the upper storage portion 31 including the upper storage chamber 65 and the lower storage portion 32 including the lower storage chamber 66. In the present embodiment, the lower storage portion 32 is integrally formed with the upper storage portion 31, below the upper storage portion 31. In the state where the toner container 3K is attached to the container support plate 49, the lower storage portion 32 is disposed in a lower portion at the right end of the drum unit 21 (see FIG. 4). That is, the lower storage portion 32 is disposed in a lower portion at the right end of the drum unit 21. It is noted that the lower storage portion 32 is an example of the waste toner container of the present disclosure. The upper storage portion 31 is an example of the supply toner container of the present disclosure.

As shown in FIG. 7, a stirring member 68 in the shape of a paddle is rotatably supported in the upper storage chamber 65. In addition, a conveyance portion 69 is provided in the upper storage chamber 65, wherein the conveyance portion 69 conveys the toner stored therein to the developing device 14. As shown in FIG. 8, the conveyance portion 69 includes a cylindrical portion 70 and a spiral member 71, wherein the cylindrical portion 70 projects from the left side of the container main body 62 to outside, and the spiral member 71 is provided in the cylindrical portion 70. In the state where the toner container 3K is attached to the housing 10A, the tip portion of the cylindrical portion 70 is connected to a supply portion 60 (see FIG. 15) provided in the housing 10A. The supply portion 60 is coupled with the supply port 58 (see FIG. 4) of the developing device 14, and includes a paddle portion 60A that is rotationally driven by a driving portion such as a motor. With this configuration, the toner in the upper storage chamber 65 is supplied to the developing device 14 by the supply portion 60 via the conveyance portion 69 and the supply port 58.

As shown in FIG. 6, the lid 64 includes a gear transmission mechanism 73. The gear transmission mechanism 73 is coupled with the spiral member 71 and a rotation shaft 68A of the stirring member 68 in a state where the opening 62A is closed by the lid 64. With this configuration, when a rotational driving force is input from the paddle portion 60A of the supply portion 60 to the spiral member 71, the spiral member 71 and the stirring member 68 rotate in conjunction with each other.

Figure 8:
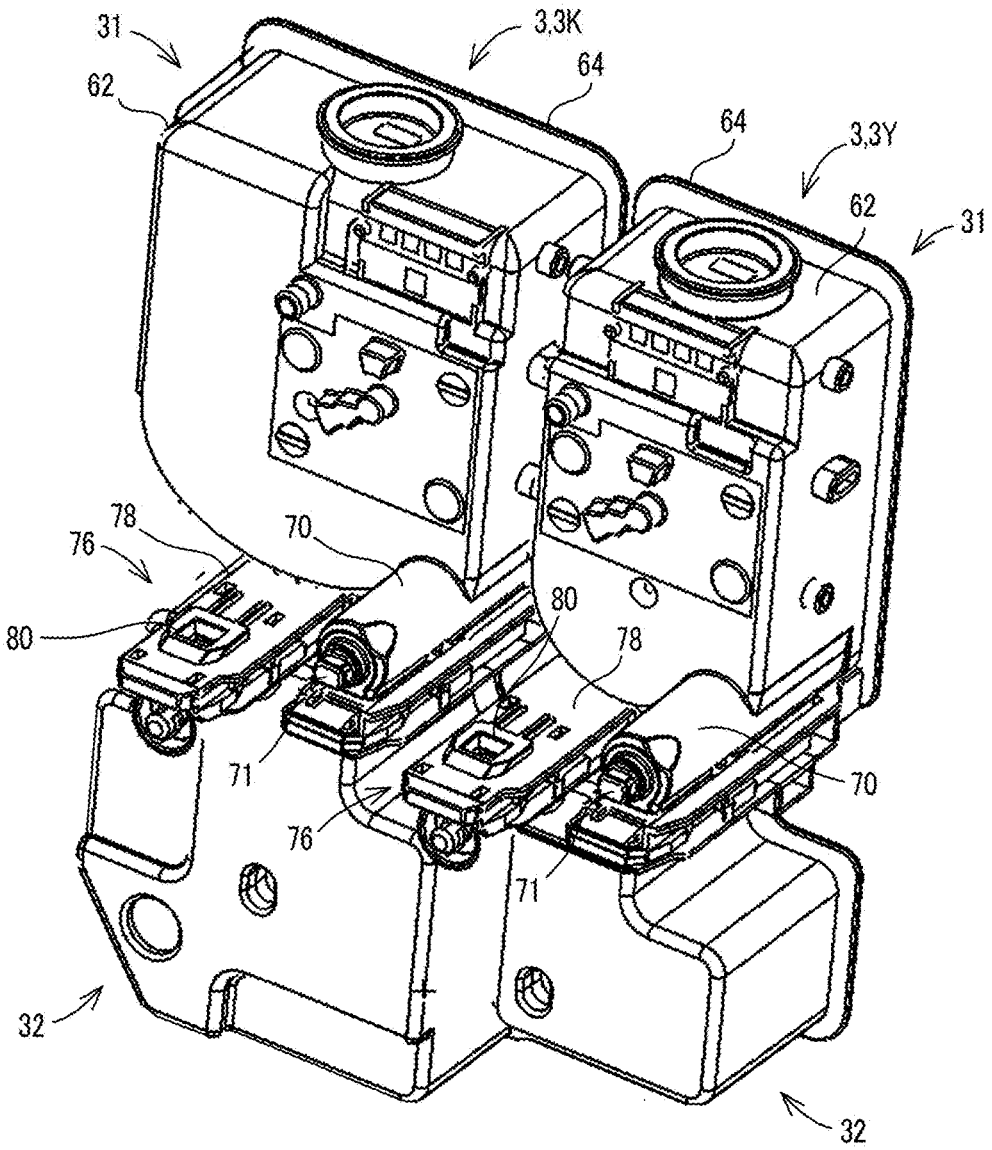
FIG. 8 is a perspective view showing configurations of rear sides of the toner containers.

As shown in FIG. 8, the lower storage portion 32 includes a conveyance portion 76 configured to convey, to the lower storage chamber 66, the waste toner discharged from the drum unit 21. The conveyance portion 76 includes a passage portion 78 that projects from the left side of the container main body 62 to outside and includes a toner conveyance path in its inside. An introduction port 80 for introducing the waste toner to the inside of the passage portion 78 is provided in an upper surface of a tip portion of the passage portion 78. In a state where the toner container 3K is attached to the housing 10A, the introduction port 80 is connected to a discharge port 92 of the toner guide portion 85 that is described below (see FIG. 15). With this configuration, the waste toner discharged from the drum unit 21 is passed through the toner guide portion 85, introduced to the inside of the passage portion 78 via the discharge port 92 and the introduction port 80, guided from the introduction port 80 to the lower storage chamber 66, and stored in the lower storage chamber 66. In the inside of the passage portion 78, a spiral member 81 is rotatably provided as a conveyance member (see FIG. 15). When a rotational driving force is transmitted to the spiral member 81 from outside, the spiral member 81 is rotated and the waste toner that has entered the inside of the passage portion 78 from the introduction port 80 is conveyed to the lower storage chamber 66.

Next, a configuration of the toner guide portions 85 and 86 provided on the drum unit 21 is described with reference to FIG. 9 to FIG. 13.

Figure 9:
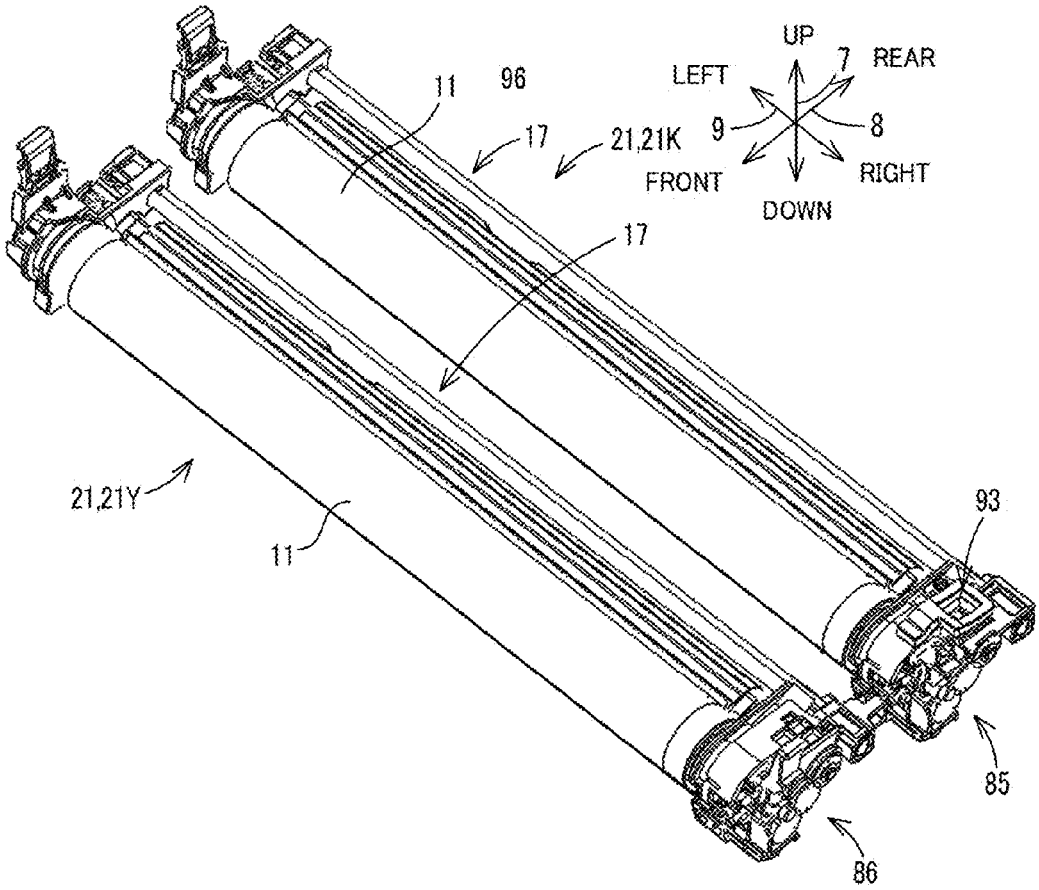
FIG. 9 is a perspective view showing drum units.

FIG. 9 is a perspective view of a drum unit 21K for black and a drum unit 21Y for yellow. As shown in FIG. 9, the drum unit 21K and the drum unit 21Y are adjacent to each other in the front-rear direction 8. It is noted that the drum units 21 for cyan and magenta have the same configuration as the drum unit 21Y.

The toner guide portion 85 is provided at the right end of the housing 36 of the drum unit 21K. That is, the toner guide portion 85 is provided in the drum unit 21K. In addition, a toner guide portion 86 is provided at the right end of the housing 36 of the drum unit 21Y. The toner guide portion 85 and the toner guide portion 86 are an example of the second guide portion of the present disclosure. It is noted that the drum units 21 for cyan and magenta each include the toner guide portion 86. As a result, each of the drum units 21 includes the toner guide portion 85 or the toner guide portion 86.

Figure 10:
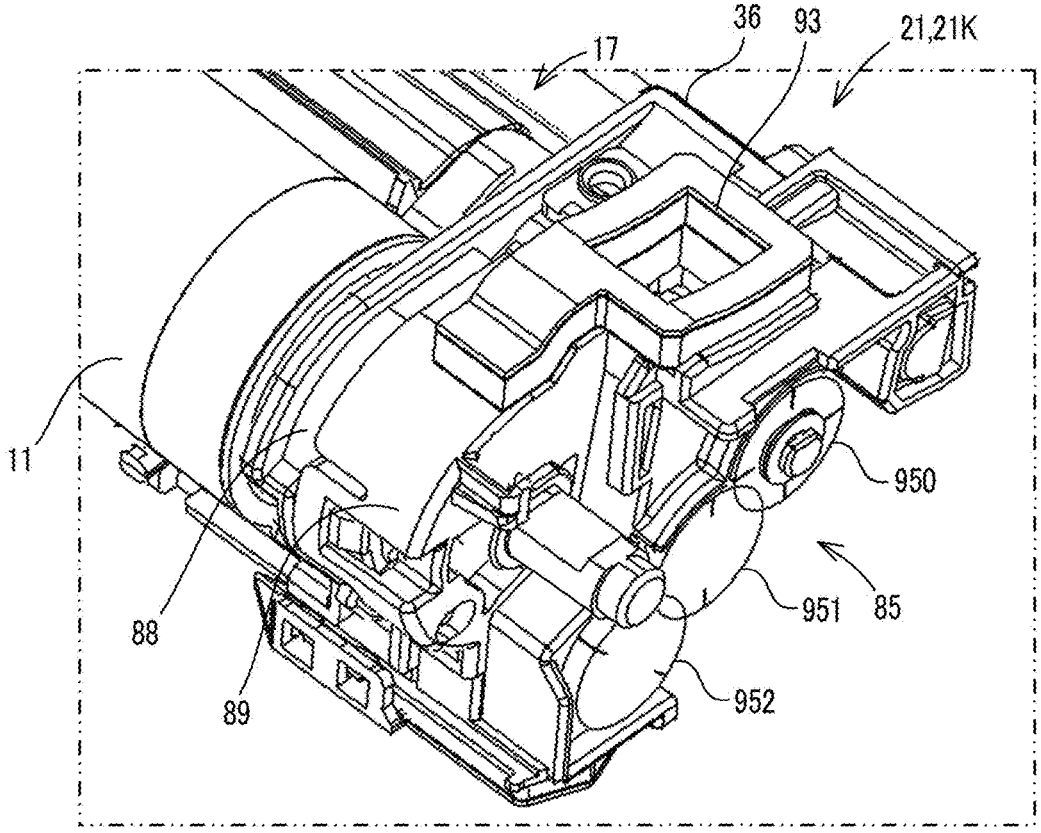
FIG. 10 is a perspective view showing a configuration of a guide portion of a drum unit for black.

FIG. 10 is an enlarged perspective view of the toner guide portion 85. In the drum unit 21K, waste toner is removed by the drum cleaning device 17 and is conveyed to the right end of the housing 36, and the toner guide portion 85 guides the waste toner from the right end of the housing 36 to the introduction port 80 of the lower storage portion 32 of the toner container 3K. In addition, as described below, the toner guide portion 85 also guides the waste toner that has been transported from the relay guide portion 100, to the introduction port 80 of the lower storage portion 32 of the toner container 3K. The toner guide portion 85 constitutes a part of the first guide portion of the present disclosure.

As shown in FIG. 10, the toner guide portion 85 includes a base portion 88 and a cover portion 89. The base portion 88 is integrally formed with the right end portion of the housing 36. The cover portion 89 covers the base portion 88 and thereby forms a waste toner conveyance path 90 in its inside (see the dotted-line arrow of FIG. 11). The conveyance path 90 extends from an upper part of the toner guide portion 85 diagonally downward, and the discharge port 92 is provided at the lower end of the conveyance path 90, the discharge port 92 being connected to the introduction port 80.

As shown in FIG. 10, in the upper surface of the cover portion 89, a reception port 93 is formed to receive waste toner discharged from the belt cleaning device 6 The reception port 93 is coupled with a discharge port 105 of the relay guide portion 100 that is described below.

Figure 11:
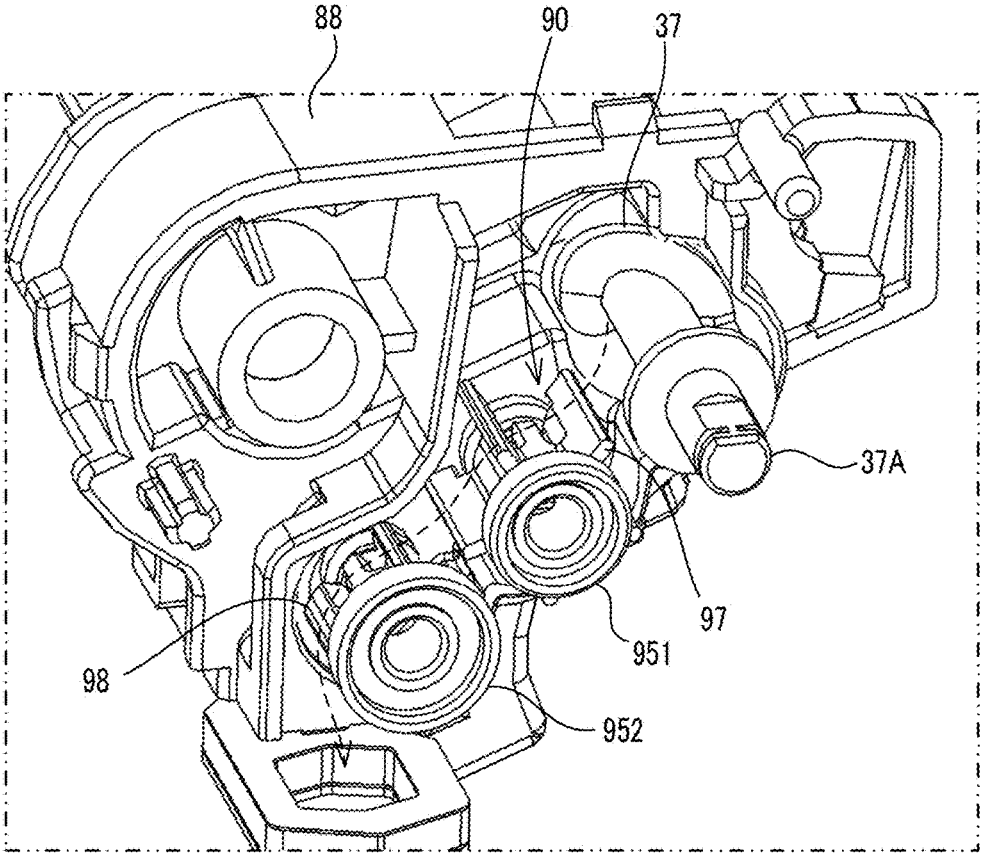
FIG. 11 is a perspective view showing an internal configuration of the guide portion.

As shown in FIG. 11, a right end portion 37A of the spiral member 37 is disposed in the conveyance path 90. The end portion 37A is rotatably supported by the cover portion 89. The end portion 37A penetrates through the cover portion 89. At the right side wall of the cover portion 89, a gear 950 (see FIG. 12) coupled with the end portion 37A is supported. The gear 950 is meshed with an idle gear (not illustrated) that is provided on a rotation shaft of the paddle portion 60A of the supply portion 60 (see FIG. 15). When a rotational driving force is transmitted from the idle gear to the gear 950, the spiral member 37 is rotated, and the waste toner is conveyed to the conveyance path 90.

Figure 12:
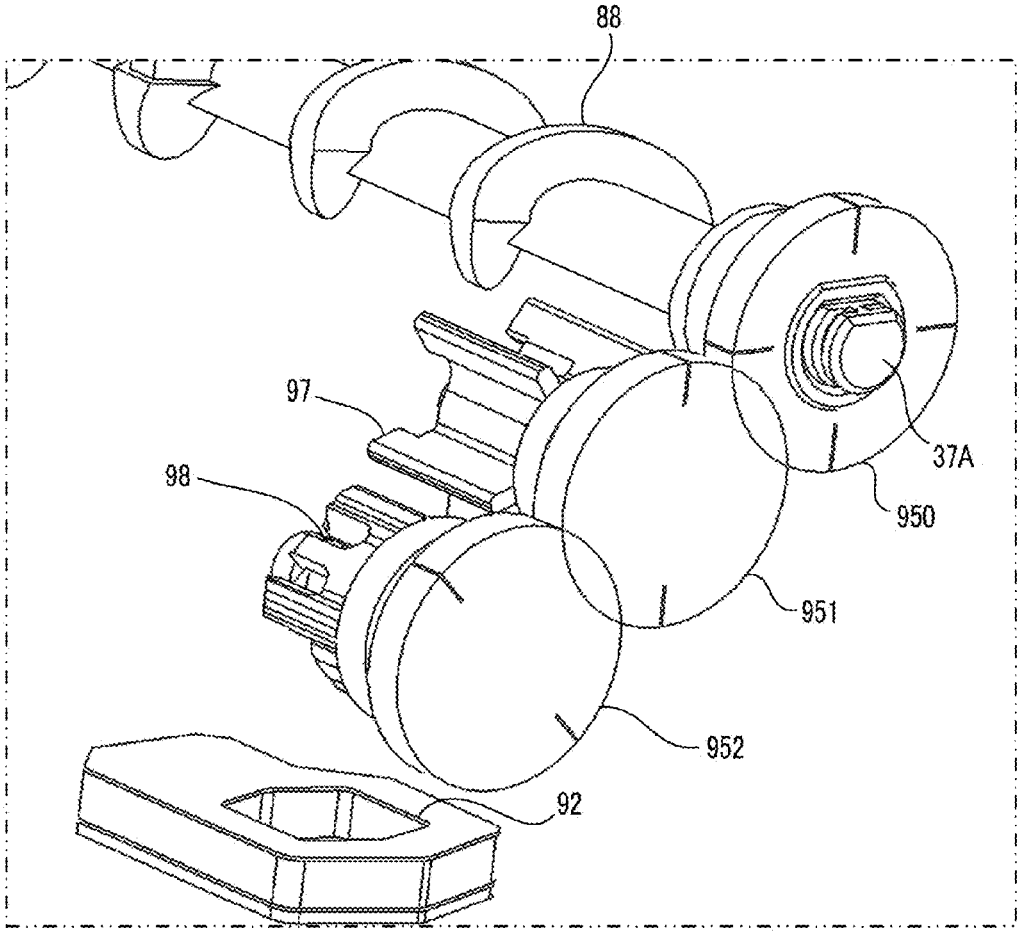
FIG. 12 is a perspective view showing a waste toner conveyance mechanism of the guide portion.

In the conveyance path 90, two paddle portions 97 and 98 are provided in the portion from the end portion 37A to the discharge port 92. The rotation shafts of the paddle portions 97 and 98 are rotatably supported by the base portion 88 and the cover portion 89. As shown in FIG. 12, the rotation shafts of the paddle portions 97 and 98 are coupled with gears 951 and 952, respectively. The gear 950 is meshed with the gear 951, and the gear 951 is meshed with the gear 952. When the rotational driving force is transmitted to the gear 950, the rotational driving force is transmitted to the gears 951 and 952, causing the paddle portions 97 and 98 to rotate. Each of the paddle portions 97 and 98 includes a plurality of blades around the rotation shaft. When the paddle portions 97 and 98 rotate, the waste toner conveyed to the conveyance path 90 in the right end side by the rotation of the spiral member 37, enters the conveyance path 90 and is conveyed in the conveyance path 90 to the discharge port 92 by the paddle portions 97 and 98.

Figure 13:
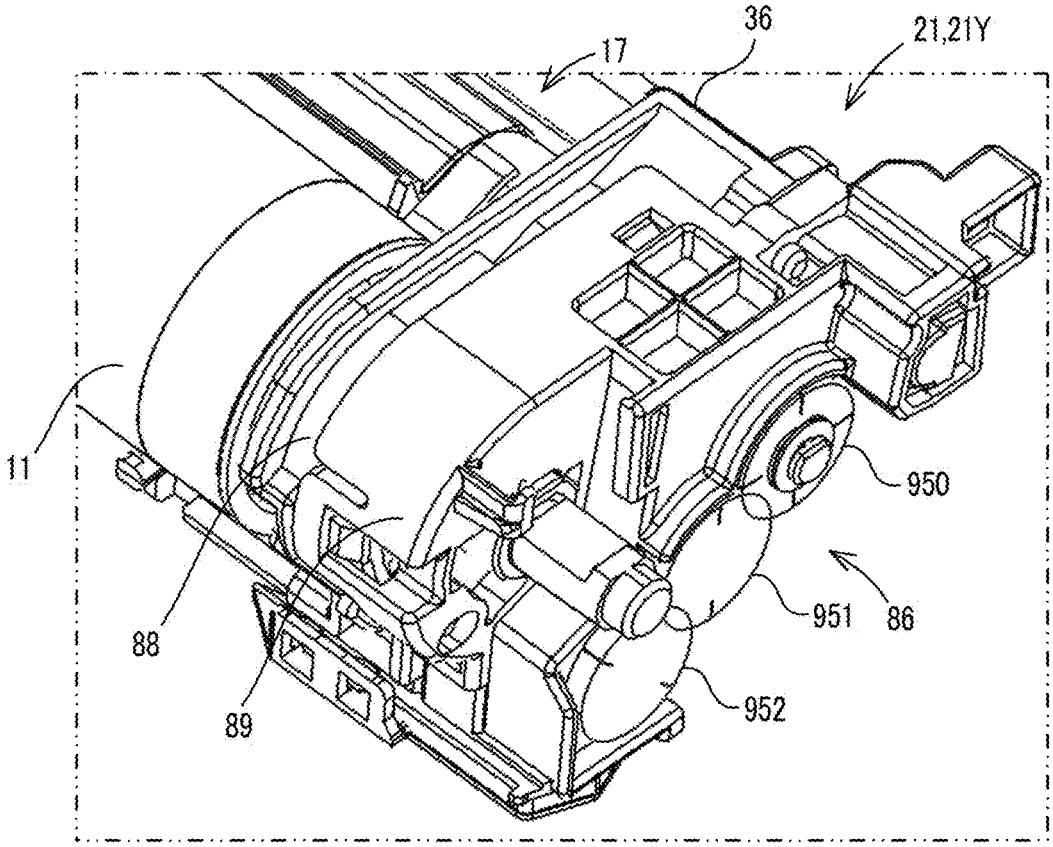
FIG. 13 is a perspective view showing a configuration of a guide portion of a drum unit for yellow.

FIG. 13 is an enlarged perspective view of the toner guide portion 86. In the drum unit 21Y, waste toner is removed by the drum cleaning device 17 and is conveyed to the right end of the housing 36, and the toner guide portion 86 guides the waste toner from the right end of the housing 36 to the introduction port 80 of the lower storage portion 32 of the toner container 3Y. The toner guide portion 86 has the same configuration as the toner guide portion 85 except that it does not include the reception port 93. In the present embodiment, the components of the toner guide portion 86 are assigned the same reference signs as those of the toner guide portion 85, and description thereof is omitted. It is noted that the toner guide portion 86 is included not only in the drum unit 21Y, but also in the drum units 21C and 21M. That is, the toner guide portion 85 is provided in the drum unit 21K, and the toner guide portion 86 is provided in each of the other three drum units 21.

Next, a configuration of the relay guide portion 100 provided in the belt cleaning device 6 is described with reference to FIG. 14 to FIG. 19B.

Figure 14:
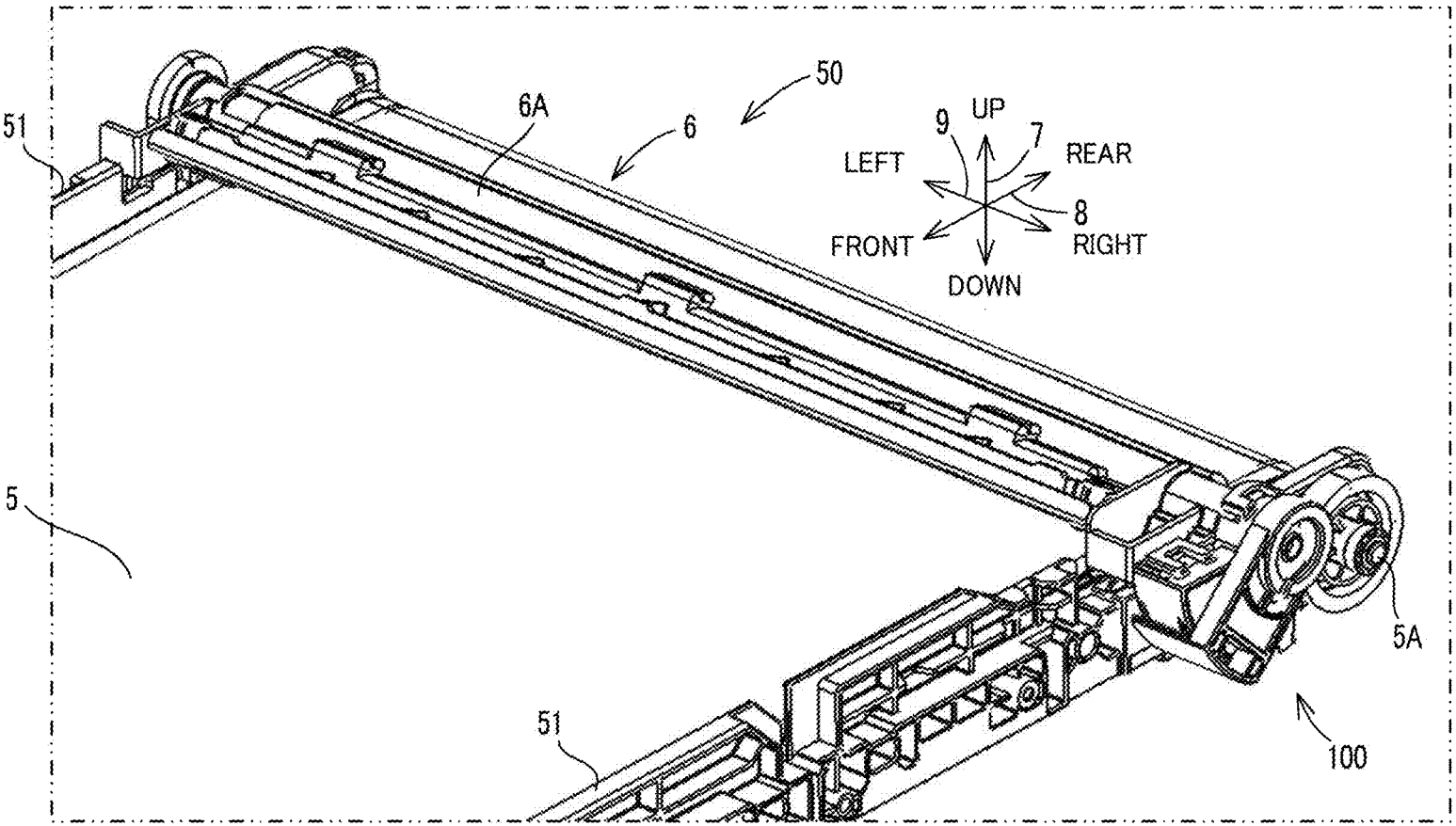
FIG. 14 is an enlarged view showing a rear side portion of the intermediate transfer unit.

FIG. 14 is a partial enlarged view of the belt cleaning device 6. As shown in FIG. 14, the relay guide portion 100 is provided at the right end of the belt cleaning device 6. In the belt cleaning device 6, the waste toner is conveyed in the housing 6C to the right end by the spiral member 6B, and the relay guide portion 100 guides the waste toner to the toner guide portion 85.

Figure 15:
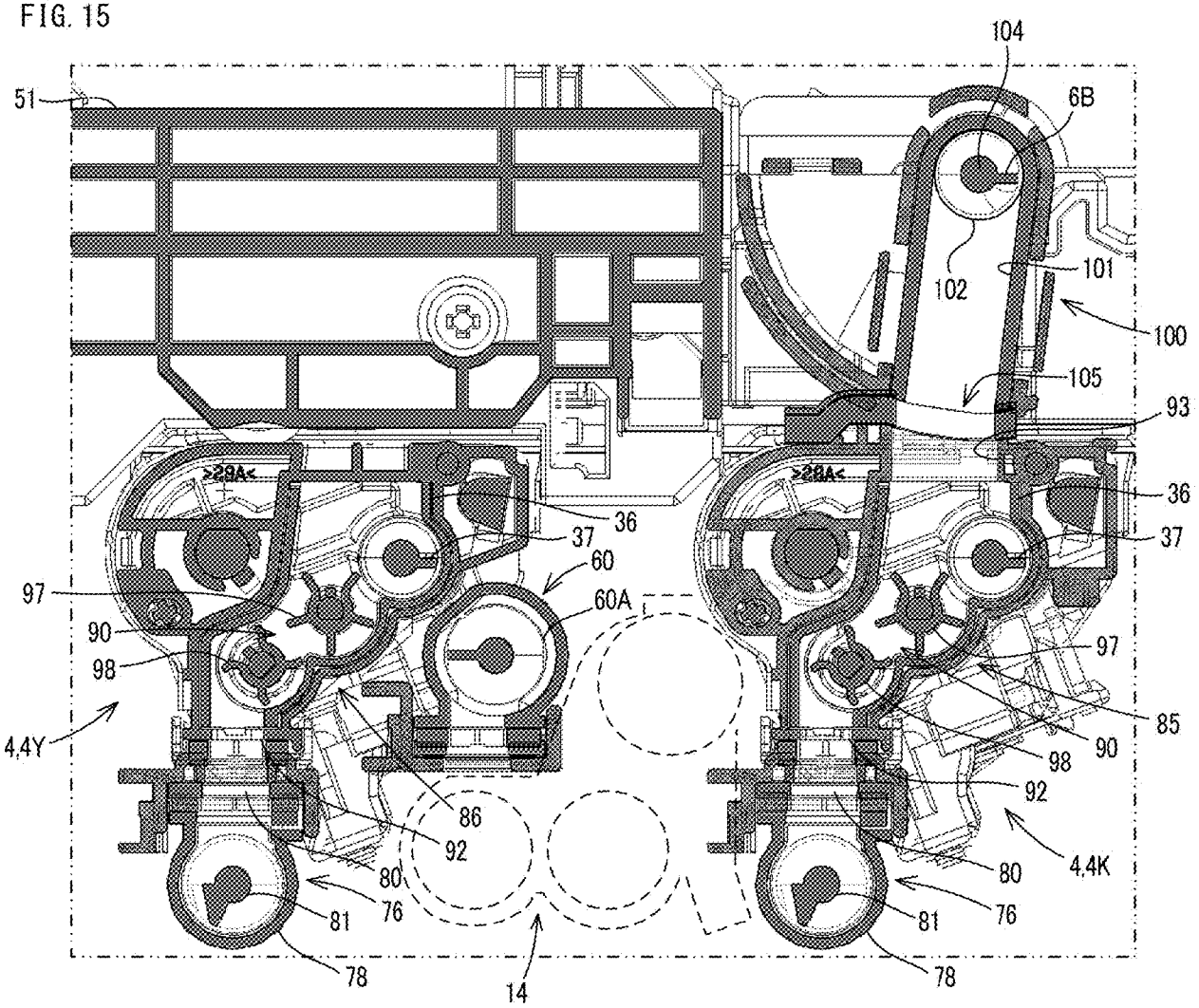
FIG. 15 is a cross-sectional view of a relay guide portion and a toner guide portion.
Figure 16:
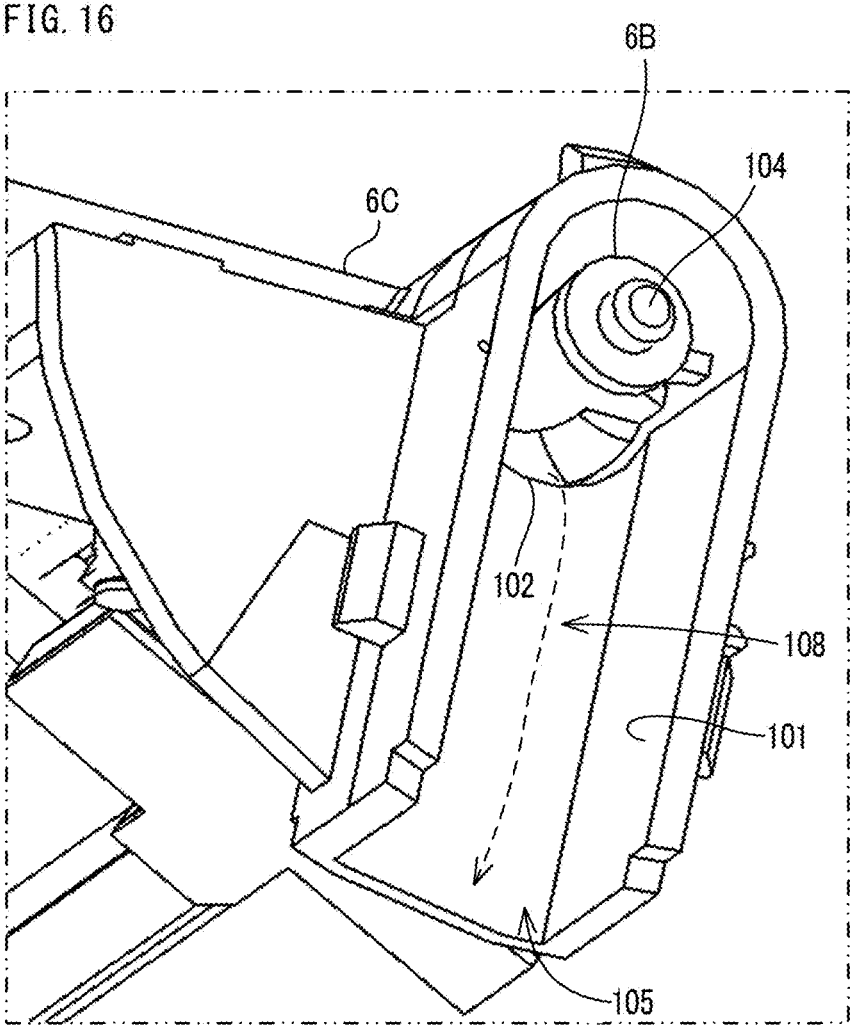
FIG. 16 is a perspective view showing an internal configuration of the relay guide portion included in the intermediate transfer unit.

As shown in FIG. 15 and FIG. 16, the relay guide portion 100 includes a conveyance groove 101 formed on the right side wall of the housing 6C. An opening 102 is formed in a groove bottom surface of the conveyance groove 101, and the opening 102 is communicated with the housing 6C. As described above, the spiral member 6B is provided in the housing 6C, and a right end portion 104 of the spiral member 6B is inserted in the opening 102 and reaches the conveyance groove 101. The conveyance groove 101 extends from the opening 102 downward, and its lower end forms a discharge port 105 that is opened downward. As shown in FIG. 15, the discharge port 105 is connected to the reception port 93 of the toner guide portion 85.

Figure 17:
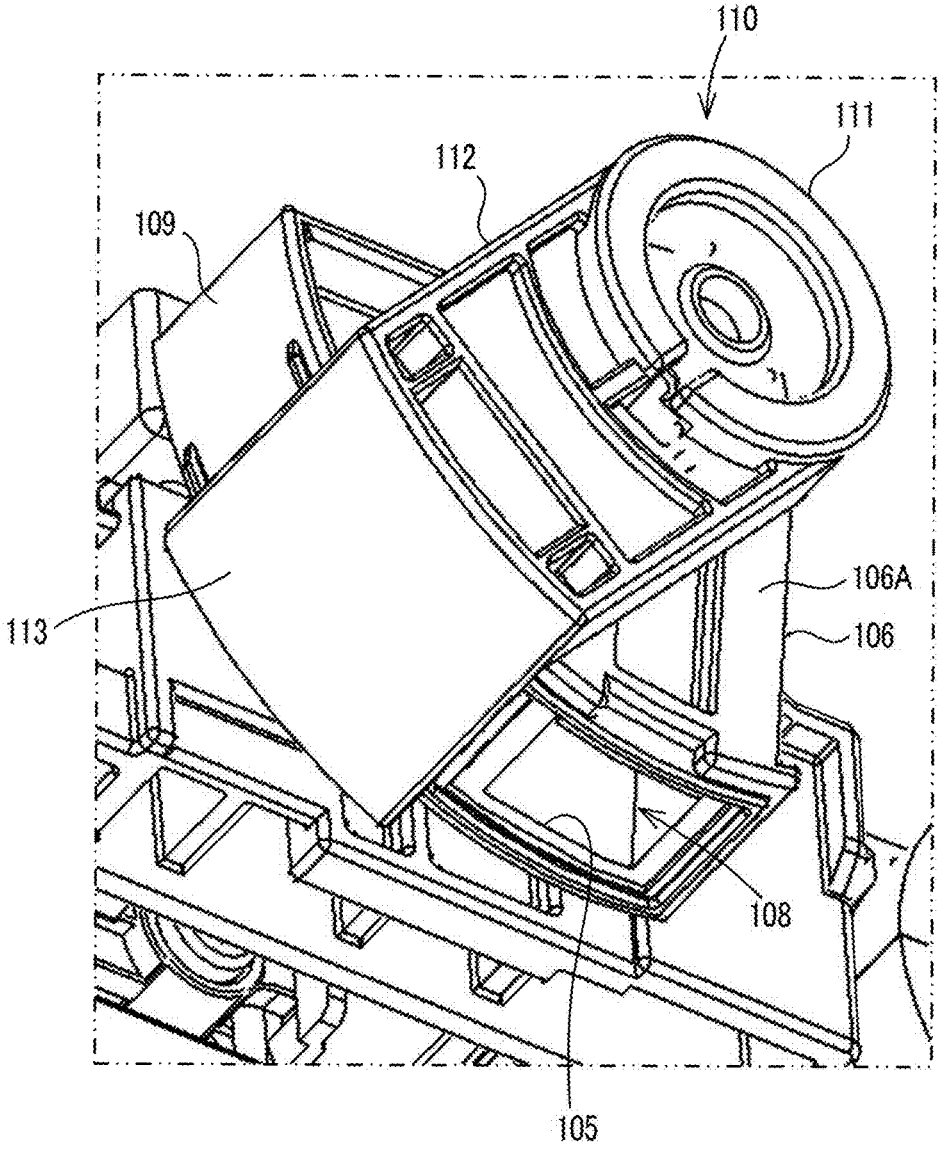
FIG. 17 is an enlarged view showing a configuration of the relay guide portion included in the intermediate transfer unit.

As shown in FIG. 17, the relay guide portion 100 includes a cover portion 106 that covers the conveyance groove 101. As the conveyance groove 101 is covered by the cover portion 106, a conveyance path 108 extending from the opening 102 to the discharge port 105 is formed (see the dotted-line arrow of FIG. 16). With this configuration, in the belt cleaning device 6, the waste toner is conveyed in the housing 6C to the right end by the spiral member 6B, and then conveyed therefrom to the conveyance path 108 via the opening 102. Thereafter, the waste toner moves in the conveyance path 108 downward, and is guided from the discharge port 105 to the reception port 93. The waste toner guided to the reception port 93 passes through the toner guide portion 85, is conveyed by the paddle portions 97 and 98 further downward, and is guided to the inside of the lower storage portion 32 via the introduction port 80.

Figure 18:
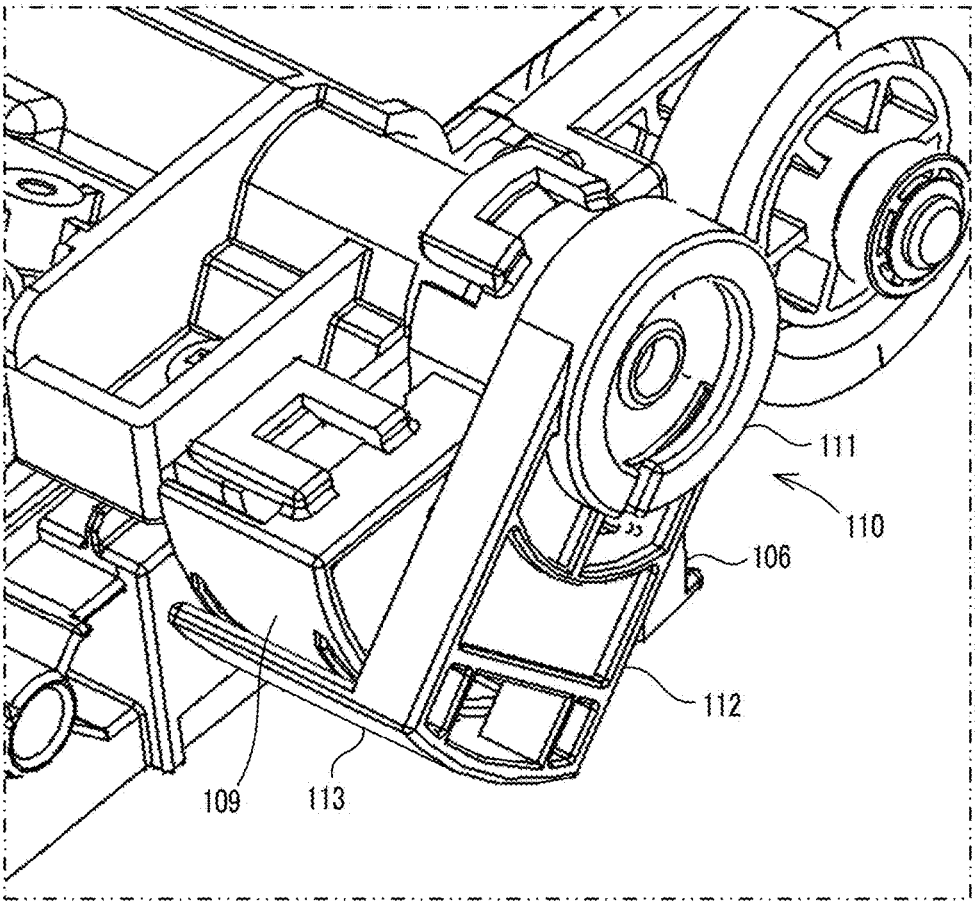
FIG. 18 is an enlarged view showing a configuration of the relay guide portion included in the intermediate transfer unit.

As shown in FIG. 17 and FIG. 18, an opening/closing member 110 is provided in a right side wall 106A of the cover portion 106, wherein the opening/closing member 110 is configured to open and close the discharge port 105. The opening/closing member 110 includes a rotary movable portion 111, an arm portion 112, and a shutter portion 113. The rotary movable portion 111 is pivotally supported by a shaft 120 (see FIG. 19A and FIG. 19B) that is provided on the right side wall 106A. The arm portion 112 is extended out from the rotary movable portion 111. The shutter portion 113 is provided at the tip of the arm portion 112. As the rotary movable portion 111 pivots, the opening/closing member 110 moves between a closing position (the position shown in FIG. 18 and FIG. 19A) and an opening position (the position shown in FIG. 17 and FIG. 19B). When the opening/closing member 110 is at the closing position, the discharge port 105 is closed by the shutter portion 113.

When the opening/closing member 110 is at the opening position, the discharge port 105 is opened. The cover portion 106 includes a guide surface 109 that extends from the discharge port 105 and is curved in an arc shape. The shutter portion 113 has a curved shape that is curved along the guide surface 109, and moves between the closing position and the opening position along the guide surface 109. As a result, the shutter portion 113 can move smoothly between the closing position and the opening position.

Figure 19A:
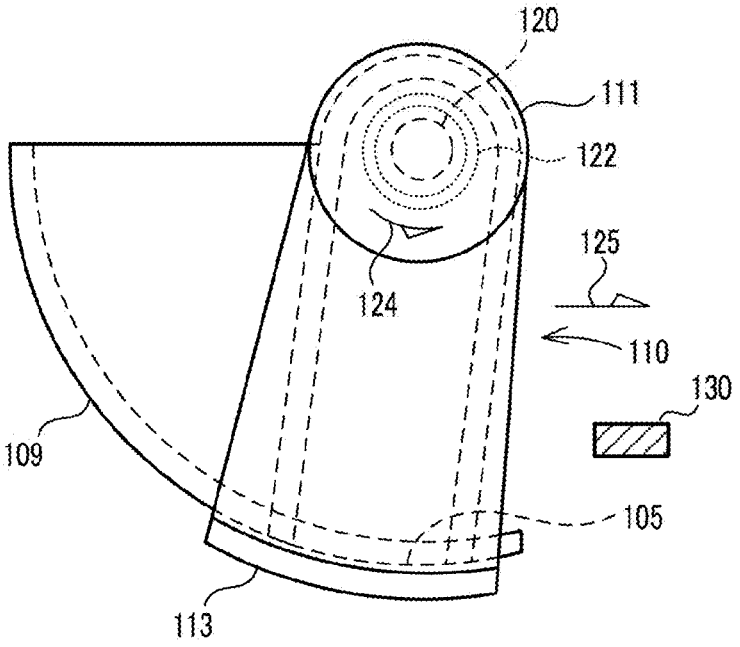
FIG. 19A and FIG. 19B are diagrams showing an operation of an opening/closing member of the relay guide portion.
Figure 19B:
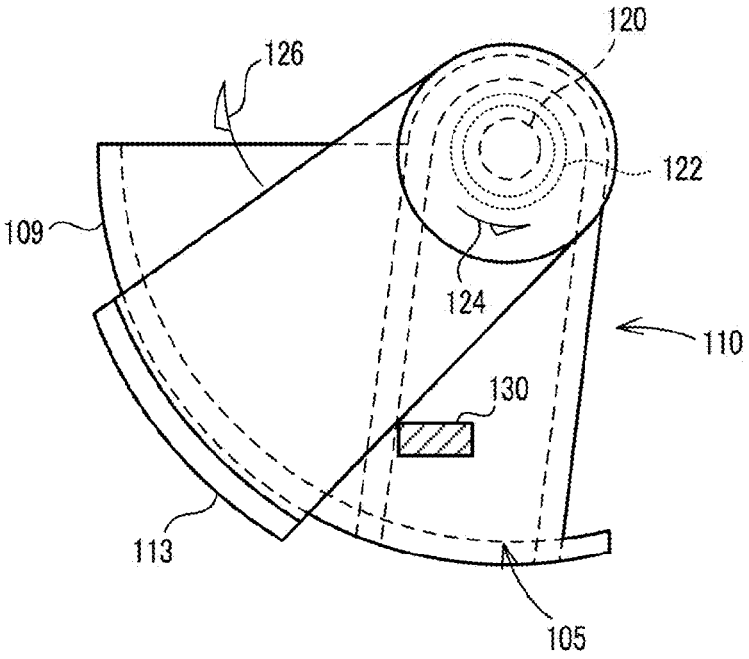

As shown in FIG. 19A, the shaft 120 includes a torsion coil spring 122 (an example of the biasing member of the present disclosure). The torsion coil spring 122 biases the opening/closing member 110 in a direction of closing the discharge port 105, namely, in a direction of moving from the opening position to the closing position (the direction indicated by the arrow 124). With this configuration, in a state where no external force is applied to the opening/closing member 110, the opening/closing member 110 is always displaced to the closing position, and stopped at the closing position by a stopper (not illustrated), thereby the state where the discharge port 105 is closed by the shutter portion 113 is maintained. It is noted that the torsion coil spring 122 is an example of the biasing member, and any other configuration is applicable to the biasing member as far as it can bias the opening/closing member 110 from the opening position to the closing position.

On the other hand, during a process where the intermediate transfer unit 50 is inserted in the housing 10A in a direction (the direction indicated by the arrow 125) toward the installment position (the position indicated in FIG. 2), the opening/closing member 110, in response to the insertion operation, moves in a direction of opening the discharge port 105 against the biasing force of the torsion coil spring 122, namely, in a direction of moving from the closing position to the opening position (the direction indicated by the arrow 126). Specifically, a pressing member 130 that is configured to press the rear end portion of the opening/closing member 110 is provided in the housing 10A. When the intermediate transfer unit 50 is inserted in the space 59 of the housing 10A from the front side toward the rear side (in the direction indicated by the arrow 125) and inserted to the front of the installment position, the pressing member 130 abuts on the rear end portion of the opening/closing member 110. Subsequently, when the intermediate transfer unit 50 is further inserted toward the rear side, the opening/closing member 110 that was abutted by the pressing member 130 receives a force from the pressing member 130, rotates about the shaft 120, and moves in the direction indicated by the arrow 126. This allows the shutter portion 113 to move from the closing position to the opening position. Subsequently, the intermediate transfer unit 50 is installed at the installment position in a state where the discharge port 105 is opened. This allows the discharge port 105 to be opened without the shutter portion 113 being operated manually.

As described above, according to the present embodiment, with a configuration where the drum cleaning device 17 and the toner guide portion 85 are included in the drum unit 21, and the belt cleaning device 6 and the relay guide portion 100 are included in the intermediate transfer unit 50, the waste toner conveyed from the belt cleaning device 6 to the relay guide portion 100 is guided in the conveyance path 108 of the relay guide portion 100 downward, and transported to the toner guide portion 85. The waste toner transported to the toner guide portion 85 is guided in the conveyance path 90 of the toner guide portion 85 downward, and transported to the lower storage portion 32 of the toner containers 3. Since the toner guide portion 85 also serves as a conveyance path for the waste toner discharged from the belt cleaning device 6, it is not necessary to include another guide member for guiding the waste toner from the belt cleaning device 6 to the lower storage portion 32. As a result, it is possible to guide the waste toner to the lower storage portion 32 without making a wasteful space in the housing 10A.

The above-described embodiment shows, as one example, a configuration where the waste toner is guided in the conveyance path 108 of the relay guide portion 100 downward and transported to the toner guide portion 85. However, the present disclosure is not limited to this configuration. For example, a guide portion that is different from the toner guide portion 85 may be provided in a free space in the housing 36 of the drum unit 21, and the waste toner from the relay guide portion 100 may be guided to the lower storage portion 32 via the other guide portion. In this case, the relay guide portion 100 and the other guide member correspond to the first guide portion of the present disclosure.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an apparatus main body;

a drum unit provided in the apparatus main body and including a photoconductor drum configured to carry a toner image developed by a developing device;

an intermediate transfer unit provided above the drum unit in the apparatus main body and including a transfer belt and a belt cleaning portion, the transfer belt being configured to carry a toner image primarily transferred from the photoconductor drum, to a position at which a secondary transfer is performed to a sheet member, the belt cleaning portion being configured to remove waste toner remaining on the transfer belt and convey the waste toner toward one side in a width direction of the transfer belt;

a waste toner container provided below an end of the drum unit on the one side and including an introduction port configured to introduce waste toner to an inside of the waste toner container;

a first guide portion configured to guide the waste toner that has been conveyed by the belt cleaning portion to the one side, from the introduction port to the inside of the waste toner container; and a supply toner container provided on a downstream side with respect to the drum unit in the conveying direction of the waste toner and storing supply toner that is supplied to the developing device, wherein the waste toner container is integrally formed with the supply toner container, below the supply toner container.

2. An image forming apparatus comprising:

an apparatus main body;

a drum unit provided in the apparatus main body and including a photoconductor drum configured to carry a toner image developed by a developing device;

an intermediate transfer unit provided above the drum unit in the apparatus main body and including a transfer belt and a belt cleaning portion, the transfer belt being configured to carry a toner image primarily transferred from the photoconductor drum, to a position at which a secondary transfer is performed to a sheet member, the belt cleaning portion being configured to remove waste toner remaining on the transfer belt and convey the waste toner toward one side in a width direction of the transfer belt;

a waste toner container provided below an end of the drum unit on the one side and including an introduction port configured to introduce waste toner to an inside of the waste toner container; and a first guide portion provided in such a way as to connect an end of the belt cleaning portion on the one side and the end of the drum unit on the one side and configured to guide the waste toner that has been conveyed by the belt cleaning portion to the one side, from an opening of the belt cleaning portion to the introduction port.

3. The image forming apparatus according to claim 2, wherein the drum unit includes a drum cleaning portion and a second guide portion, the drum cleaning portion being configured to remove waste toner remaining on the photoconductor drum and convey the waste toner toward the one side, the second guide portion being configured to guide the waste toner that has been conveyed by the drum cleaning portion to the one side, from the end of the belt cleaning portion on the one side to the introduction port, and the first guide portion includes the second guide portion, and guides the waste toner that was removed by the belt cleaning portion, to the inside of the waste toner container via the second guide portion.

4. An image forming apparatus comprising:

an apparatus main body;

a drum unit provided in the apparatus main body and including a photoconductor drum configured to carry a toner image developed by a developing device;

an intermediate transfer unit provided above the drum unit in the apparatus main body and including a transfer belt and a belt cleaning portion, the transfer belt being configured to carry a toner image primarily transferred from the photoconductor drum, to a position at which a secondary transfer is performed to a sheet member, the belt cleaning portion being configured to remove waste toner remaining on the transfer belt and convey the waste toner toward one side in a width direction of the transfer belt;

a waste toner container provided below an end of the drum unit on the one side and including an introduction port configured to introduce waste toner to an inside of the waste toner container; and a first guide portion configured to guide the waste toner that has been conveyed by the belt cleaning portion to the one side, from the introduction port to the inside of the waste toner container, wherein a plurality of the drum units are provided along the transfer belt, a plurality of the waste toner containers are provided in correspondence with the drum units, each of the drum units includes:

a drum cleaning portion configured to remove waste toner remaining on the photoconductor drum and convey the waste toner toward the one side; and a second guide portion configured to guide the waste toner that has been conveyed by the drum cleaning portion to the one side, from the introduction port to the inside of the waste toner container, and the first guide portion includes a relay guide portion and a second guide portion that is provided in a drum unit located closest to the belt cleaning portion, the relay guide portion being configured to guide the waste toner that has been conveyed by the belt cleaning portion to the one side, to the second guide portion, and the first guide portion guides the waste toner that was removed by the belt cleaning portion, to the inside of the waste toner container via the relay guide portion and the second guide portion.

5. The image forming apparatus according to claim 4, wherein the belt cleaning portion is provided above the transfer belt, and the drum unit located closest to the belt cleaning portion is located directly below the belt cleaning portion.

6. The image forming apparatus according to claim 4, wherein the drum unit located closest to the belt cleaning portion is a drum unit for black toner developed during an image forming process in the image forming apparatus.

7. The image forming apparatus according to claim 4, wherein the intermediate transfer unit is supported by the apparatus main body in such a way as to be inserted and removed horizontally to/from an installment position in the apparatus main body, the image forming apparatus further comprising:

an opening/closing member configured to open and close a discharge port that is provided in the relay guide portion to guide the waste toner to the second guide portion;

a biasing member configured to bias the opening/closing member toward a direction of closing the discharge port; and a pressing member configured to, in response to an operation of inserting the intermediate transfer unit toward the installment position, abut on the opening/closing member and press the opening/closing member toward a direction of opening the discharge port against the biasing force of the biasing member.

* * * * *